US008505734B1

(12) United States Patent
Wise

(10) Patent No.: US 8,505,734 B1
(45) Date of Patent: Aug. 13, 2013

(54) APPARATUS FOR REMOVING MAGNETIC MATERIALS

(76) Inventor: David C. Wise, Lebanon, KY (US)

( * ) Notice: Subject to any disclaimer, the term of this patent is extended or adjusted under 35 U.S.C. 154(b) by 149 days.

(21) Appl. No.: 12/957,863

(22) Filed: Dec. 1, 2010

Related U.S. Application Data

(60) Provisional application No. 61/265,835, filed on Dec. 2, 2009.

(51) Int. Cl.
*B03C 1/00* (2006.01)

(52) U.S. Cl.
USPC ..... 209/39; 209/206; 209/223.1; 209/225; 209/229

(58) Field of Classification Search
USPC ..... 209/39, 213, 223.1, 225, 229, 230, 209/206, 904; 210/222, 223
See application file for complete search history.

(56) References Cited

U.S. PATENT DOCUMENTS

| | | | | |
|---|---|---|---|---|
| 494,969 | A | | 4/1893 | Stiles |
| 873,951 | A | | 12/1907 | Langerfeld |
| 1,692,590 | A | * | 11/1928 | Stearns ..... 209/226 |
| 2,604,207 | A | | 7/1952 | Scott |
| 3,042,211 | A | | 7/1962 | El-Hindi |
| 3,168,464 | A | | 2/1965 | Ferris et al. |
| 3,344,062 | A | | 9/1967 | Kosar |
| 3,357,559 | A | | 12/1967 | Israelson |
| 3,474,892 | A | | 10/1969 | Spodig |
| 3,476,232 | A | | 11/1969 | Merwin et al. |
| 3,487,939 | A | | 1/1970 | Keeley |
| 3,833,542 | A | | 9/1974 | Lazarus |
| 4,051,023 | A | | 9/1977 | Fogle et al. |
| 4,055,497 | A | * | 10/1977 | Creps et al. ..... 210/91 |
| 4,154,682 | A | | 5/1979 | Matsuoka |
| 4,166,788 | A | | 9/1979 | Druz et al. |
| 4,370,228 | A | | 1/1983 | Tashiro et al. |
| 4,768,645 | A | | 9/1988 | Farris |
| 4,834,870 | A | | 5/1989 | Osterberg et al. |
| 4,858,769 | A | * | 8/1989 | DeVries ..... 209/3.1 |
| 4,895,647 | A | | 1/1990 | Uchiyama |
| 5,394,991 | A | | 3/1995 | Kumagai et al. |
| 6,068,133 | A | | 5/2000 | Schonfeld et al. |
| 6,086,761 | A | | 7/2000 | Green |
| 6,277,276 | B1 | | 8/2001 | Bratten |
| 6,325,927 | B1 | | 12/2001 | Green |
| 6,638,430 | B2 | | 10/2003 | Bratten |
| 6,946,078 | B2 | | 9/2005 | Minevski et al. |
| 7,022,224 | B2 | | 4/2006 | Stafeev |

(Continued)

FOREIGN PATENT DOCUMENTS

| | | |
|---|---|---|
| JP | 61293563 | 12/1986 |
| JP | 1056156 | 3/1989 |
| JP | 4046624 | 2/1992 |

*Primary Examiner* — Joseph C Rodriguez
(74) *Attorney, Agent, or Firm* — Middleton Reutlinger; Scott W. Higdon

(57) ABSTRACT

Disclosed herein are various inventive methods and apparatus related to removing magnetic materials from a liquid solution utilizing an apparatus employing a conveyor belt. The conveyor belt may have a forward run moving in a forward direction from a first pulley to a second pulley and a rearward run moving in a rearward direction from the second pulley to the first pulley. The apparatus may include a longitudinally extending magnet housing interposed between the forward run of the conveyor belt and the rearward run of the conveyor belt and interposed between the first pulley and the second pulley. At least one longitudinally extending magnet may be substantially sealingly enclosed in the magnet housing.

19 Claims, 4 Drawing Sheets

(56) References Cited

U.S. PATENT DOCUMENTS 7,314,140 B2 * 1/2008 Cullom et al. ..... 209/173
7,341,154 B2 * 3/2008 Boer ..... 209/172.5
2002/0175055 A1 * 11/2002 Ryde ..... 198/847
2003/0089425 A1 * 5/2003 Alvarez-Vega et al. ..... 148/101
2007/0034554 A1 2/2007 Van Der Weijden et al.
2008/0251435 A1 10/2008 Tashiro et al.

* cited by examiner

APPARATUS FOR REMOVING MAGNETIC MATERIALS

CROSS-REFERENCE TO RELATED DOCUMENTS

This Application claims priority to, and benefit from, currently pending Provisional Application Ser. No. 61/265,835, filed Dec. 2, 2009 and entitled Apparatus for Removing Magnetic Materials, which is hereby incorporated by reference in its entirety

TECHNICAL FIELD

The present invention is directed generally to an apparatus for removing magnetic materials. More particularly, various inventive methods and apparatus disclosed herein relate to removing magnetic materials from a liquid solution utilizing an apparatus employing a conveyor belt.

SUMMARY

The present disclosure is directed to inventive methods and apparatus for removing magnetic materials, and, more specifically, various inventive methods and apparatus disclosed herein relate to removing magnetic materials from a liquid solution utilizing an apparatus employing a conveyor belt. For example, in certain embodiments the apparatus may be a self contained apparatus and may have a magnet housing interior to and separate from a conveyor belt. The self contained apparatus may be selectively insertable into a desired container having a liquid solution for selective removal of magnetic materials from the liquid solution.

Generally, in one aspect, an apparatus for removing magnetic materials from a liquid solution includes a frame supporting a first pulley and a second pulley distal the first pulley. The apparatus further includes an endless conveyor belt rotating about the first pulley and the second pulley, the conveyor belt having a plurality of generally U shaped protrusions integrally formed on an outward facing surface thereof. The conveyor belt has an upper forward run moving in a forward direction from the first pulley to the second pulley and a lower rearward run moving in a rearward direction from the second pulley to the first pulley. The apparatus further includes a longitudinally extending magnet housing interposed between the forward run of the conveyor belt and the rearward run of the conveyor belt and interposed between the first pulley and the second pulley. The apparatus further includes at least one longitudinally extending magnet substantially sealingly enclosed in the magnet housing. A bottom portion of the magnet housing that is interposed between the magnet and the rearward run is substantially thicker than a top portion of the magnet housing interposed between the magnet and the rearward run. The apparatus further includes a scraper assembly adjacent the second pulley and longitudinally beyond the at least one longitudinally extending magnet housing, the scraper assembly having a rotatable magnetic drum and a scraper immediately adjacent the magnetic drum.

In some embodiments the magnet housing is an integrally molded piece. In some versions of these embodiments the magnet housing includes polypropylene.

In some embodiments the entirety of the forward run is linear.

In some embodiments the magnetic drum includes a plurality of equidistantly spaced magnets therein arranged transverse to the rotation of the magnetic drum.

In some embodiments the apparatus is a self contained apparatus removably insertable into a separate container for removing magnetic materials therefrom.

Generally, in another aspect, a magnetic material removal system, includes a container containing a liquid solution, the liquid solution having magnetic material therein. The system further includes a self contained apparatus partially submerged in the liquid solution. The apparatus includes a frame supporting a first pulley submerged in the liquid solution and a second pulley distal the first pulley. The second pulley is not submerged in the liquid solution and is disposed upward and away from the first pulley. The apparatus further includes a conveyor belt rotating about the first pulley and the second pulley, the conveyor belt being partially submerged in the liquid solution and having a plurality of generally U shaped protrusions integrally formed on an outward facing surface thereof. The submerged portion of the conveyor belt is in free communication with the liquid solution in the container. The conveyor belt has an upper forward run moving in a forward direction from the first pulley to the second pulley and a lower rearward run moving in a rearward direction from the second pulley to the first pulley. The entirety of the forward run is linear and at an angle from thirty to sixty degrees with respect to the top of the liquid solution. The apparatus further includes a longitudinally extending magnet housing interposed between the forward run of the conveyor belt and the rearward run of the conveyor belt and interposed between the first pulley and the second pulley. The apparatus further includes at least one longitudinally extending magnet substantially sealingly enclosed in the magnet housing. The apparatus further includes a scraper assembly adjacent the second pulley, the scraper assembly having a rotating magnetic drum and a scraper immediately adjacent the magnetic drum.

In some embodiments the scraper assembly is located entirely longitudinally beyond the at least one longitudinally extending magnet housing. In versions of these embodiments the scraper assembly is located immediately adjacent a portion of the rearward run. In versions of these embodiments the scraper assembly includes a magnetic material catch basin coupled thereto.

In some embodiments the entirety of the forward run is at an angle from forty to fifty degrees with respect to the top of the liquid solution.

In some embodiments the longitudinal length of the magnet housing is less than eighty percent of the longitudinal length of the forward run. In versions of these embodiments the magnet housing is an integrally molded piece.

In some embodiments the system further comprising at least one nozzle positioned above the liquid solution. In versions of these embodiments the nozzle produces an output directed atop the liquid solution in the direction of the apparatus, whereby the output directs floating of the magnetic materials toward the apparatus. Optionally, the output includes air.

In some embodiments the magnet housing is removably coupled to the frame.

In some embodiments the container has a bottom surface, at least two sidewalls extending upwardly from the bottom surface, and a top extending between the at least two sidewalls. The top of the container has an access opening therein and the apparatus is configured for removable insertion in the container via the access opening.

In some embodiments a bottom portion of the magnet housing that is interposed between the magnet and the rearward run is substantially thicker than a top portion of the magnet housing interposed between the magnet and the rearward run. In versions of these embodiments the bottom portion is at least six times thicker than the top portion.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
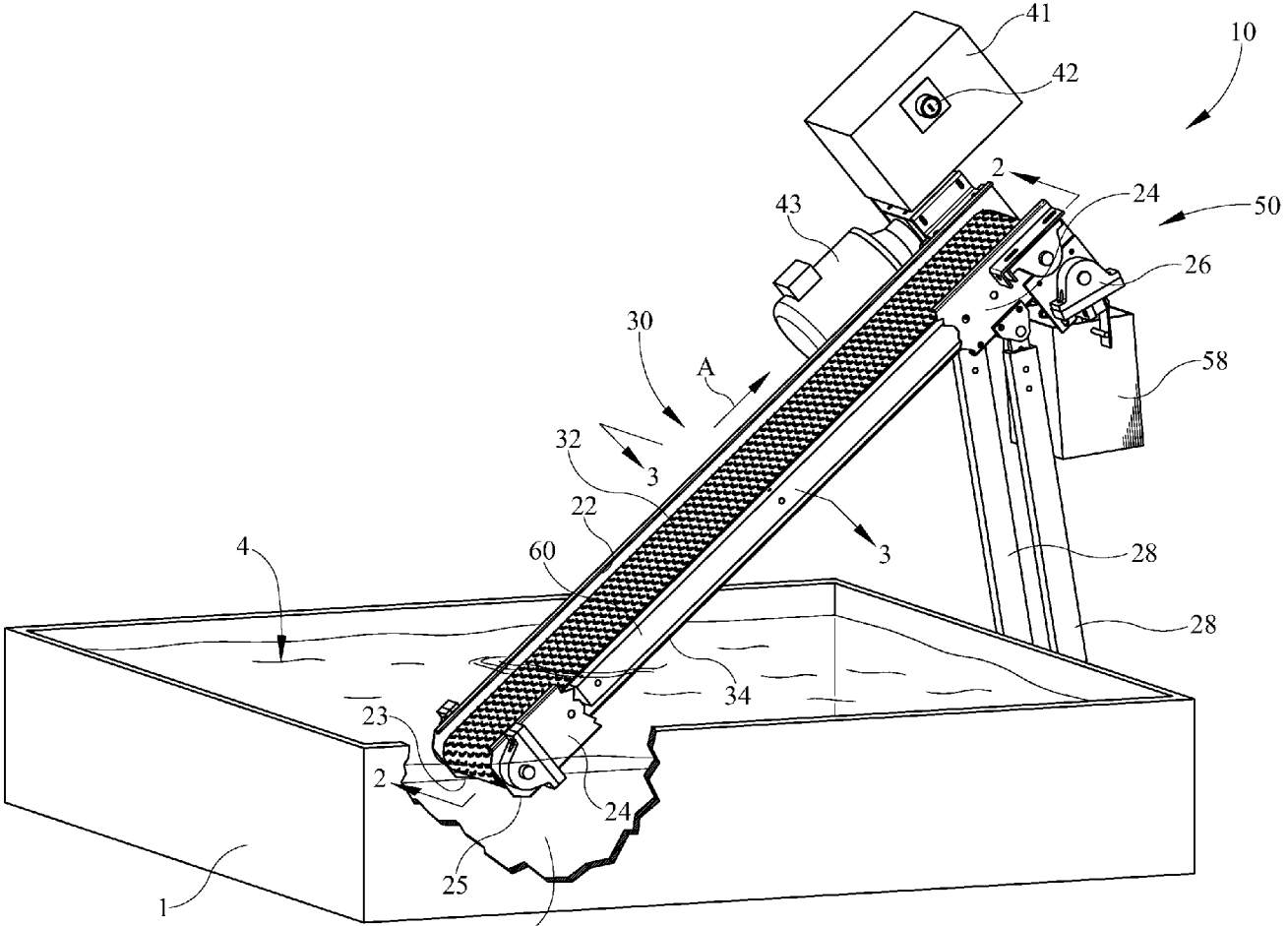
FIG. 1 illustrates an embodiment of a magnetic material removal system having an apparatus for removing magnetic materials from a liquid solution that is partially submerged in a container having a liquid solution with magnetic materials therein; a portion of a frame of the apparatus is shown broken away and a portion of the container is also shown broken away.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention.

Referring now to FIG. 1 through FIG. 4, various embodiments of methods and apparatus for removing materials from a liquid solution will be described in detail. Throughout the Figures an embodiment of an apparatus 10 for removing suspended or floating magnetic materials from a liquid solution is shown partially submerged in a container 1 having a liquid solution 3 with magnetic materials therein. In some embodiments the apparatus 10 may also remove non-magnetic floating materials from the liquid solution 3. As described in additional detail herein, the depicted apparatus 10 is a self contained apparatus and may be readily removably inserted in a selected of a plurality of containers as desired. For example, a single of the apparatus 10 may be moved between a plurality of containers similar to container 1 throughout a facility to selectively remove magnetic materials from a desired single of the containers. Also, for example, the apparatus 10 may be readily removably inserted into a container that differs in one or more respects from container 1. For example, the apparatus 10 may be readily inserted in a container having higher sidewalls than container 1 and have a top extending between the sidewalls. The apparatus 10 may be removably insertable into the container via, for example, an access door provided in the top of the container. Also, for example, the apparatus 10 may also be insertable into containers having different depths of liquid solution than that depicted throughout the Figures. In some embodiments the liquid solution 3 may be an aqueous solution and in other embodiments the solution 3 may be an oil-based solution.

The arrangement and configuration of various components of apparatus 10 may allow for selective insertion into a desired container of a plurality of containers and for removal of magnetic materials from a liquid solution within the desired container. The apparatus 10 may be used for removal of magnetic materials in a number of operating environments. For example, the apparatus 10 may be used for the removal of floating and/or suspended waste in pre-treatment systems, metal milling systems, cooling systems, and/or metal stamping systems.

The apparatus 10 includes a frame having frame side supports 22 and 24 flanking an endless conveyor belt 30. The endless conveyor belt 30 is depicted disposed at an approximately forty-five degree angle with respect to the top 4 of the liquid solution 3. Frame side support 22 and frame side support 24 have respective chamfered contact surfaces 23 and 25 that rest on the bottom of the container 1 and help support the apparatus 10 at a desired of a plurality of orientations. In alternative embodiments the contact surfaces 23 and 25 may be alternatively configured to allow for sufficient contact with the bottom of the container 1 to support the apparatus 10 at a desired of a plurality of orientations. For example, the contact surfaces 23 and 25 may be hingedly adjustable, may include a plurality of chamfered surfaces, may be provided with a rounded contact surface, and/or may be provided with adjustable legs or other extensions. A pair of legs 28 are provided distal contact surfaces 23 and 25. The legs 28 support the frame side support 22 and the frame side support 24 and may be slidably and/or hingedly adjusted to orient the apparatus 10 at a desired orientation. For example, the legs 28 may be hingedly and slidably adjusted to orient the conveyor belt 30 at approximately a thirty to sixty degree angle with respect to the top 4 of the liquid solution 3.

In alternative embodiments the legs 28 may be omitted. For example, in some embodiments the legs 28 may be omitted and the apparatus 10 may include a bracket that may be attached to a rope or chain and hoisted by the rope or chain at a desired orientation. Also, for example, in some embodiments the legs 28 may be omitted and one or more pegs may extend outwardly from the frame side supports 22 and 24 and the pegs may rest on a support surface such as, for example, the top of a container or structure surrounding the top of the container. In some embodiments the frame side supports 22 and 24 may comprise stainless steel.

Figure 2:
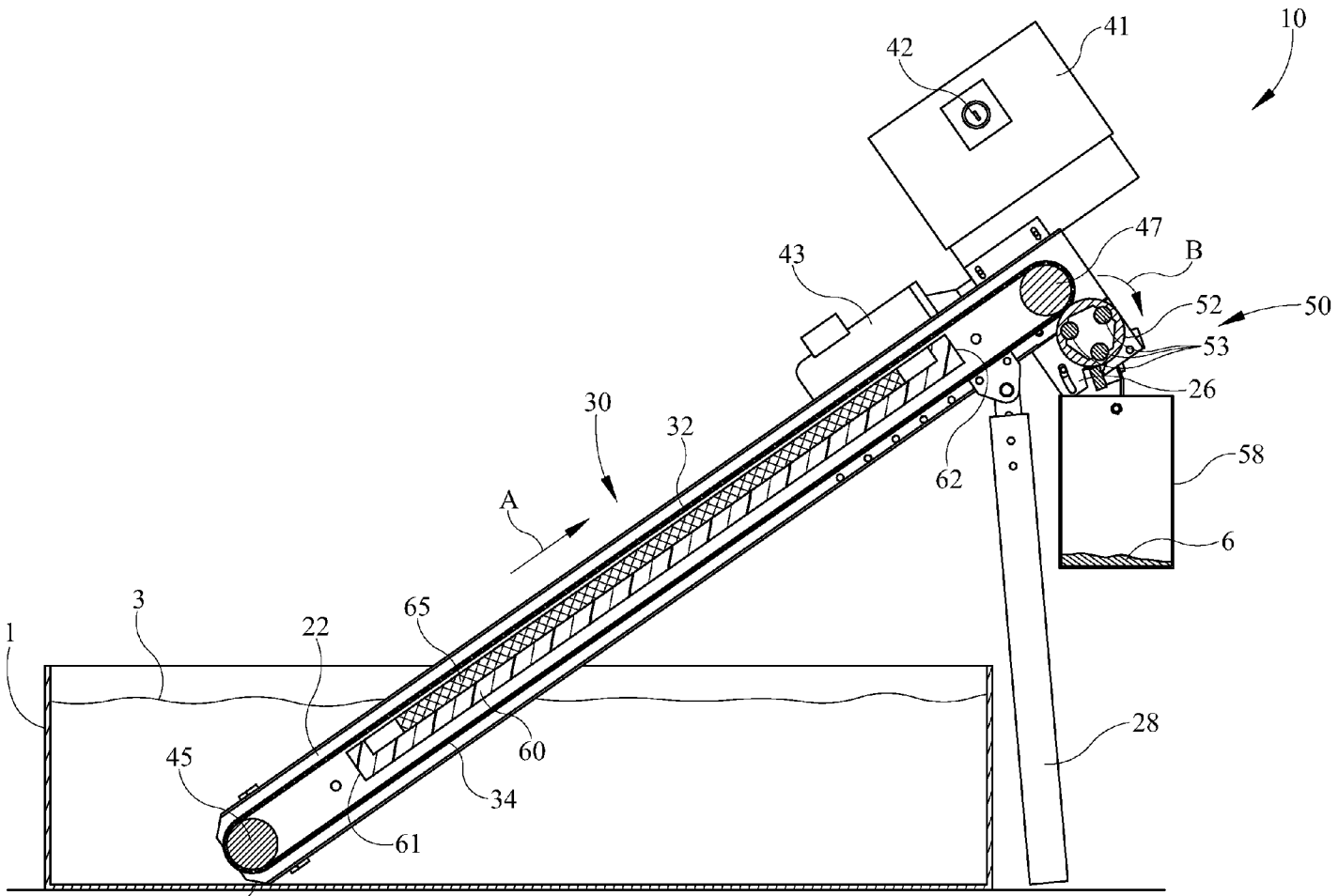
FIG. 2 illustrates a side sectional view of the apparatus of FIG. 1 in the container of FIG. 1 taken along the section line 2-2 of FIG. 1.
Figure 3:
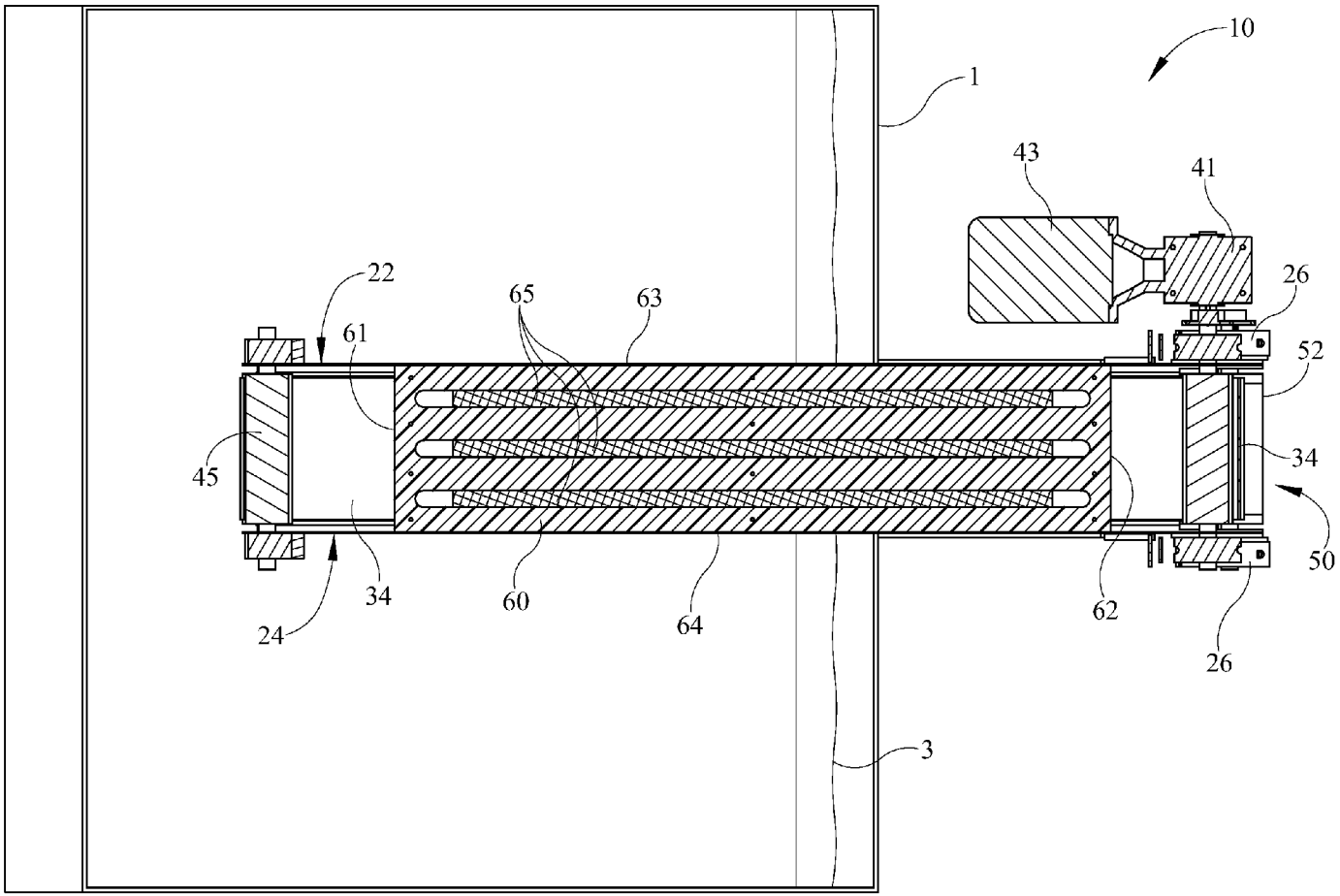
FIG. 3 illustrates a top sectional view of the apparatus of FIG. 1 in the container of FIG. 1 taken along the section line 3-3 of FIG. 1.

The frame side supports 22 and 24 support a lower pulley 45 shown in FIGS. 2 and 3 submerged in the liquid solution 3. The frame side supports 22 and 24 also support an upper pulley 47 distal the lower pulley 45 and disposed upward and away from the lower pulley 45. The endless conveyor belt 30 rotates about the lower pulley 45 and the upper pulley 47 in a direction indicated by arrow A. In the depicted embodiment the upper pulley 45 is driven by a motor 43 and the lower pulley 45 is not driven, but allows for rotation of the conveyor belt 30 thereabout. In alternative embodiments the lower pulley 45 may be additionally or alternatively driven by motor 43 or another motor. In some embodiments the motor may be a one-half horse power AC motor and a 60:1 gearbox may be provided between the motor 43 and the upper pulley 47. In some embodiments the lower pulley 45 and/or upper pulley 47 may include sealed corrosion resistant bearings. In some embodiments the distance between the lower pulley 45 and/or upper pulley 47 may be adjustable to allow for removal of the conveyor belt 30 and/or to allow for adjustment of the tension of the conveyor belt 30.

A controller 41 is in electrical communication with the motor 43 and an external power source and selectively provides power to the motor 43. The controller 41 has an actuable ON/OFF button 42 that selectively controls the motor 43. Optionally, one or more sensors may be in communication with the controller 41. For example, a timer may be in communication with the controller 41 to cause the motor 43 to be turned off after a predetermined amount of run time and/or a sensor may be disposed in the liquid solution 3 that measures characteristics indicative of the concentration of magnetic material in the liquid solution 3 and causes the motor 43 to be turned off after the concentration drops below a threshold amount.

The conveyor belt 30 has a conveyor belt forward run 32 and a conveyor belt rearward run 34. In the depicted embodiment both the forward run 32 and the rearward run 34 are linearly extending and are both disposed at an approximately forty-five degree angle with respect to the top 4 of the liquid solution 3. A plurality of generally U shaped protrusions 36 are integrally formed on an outward facing surface of the conveyor belt 30. In the depicted embodiment a plurality of sequential rows of U shaped protrusions 36 are provided with each row having seven U shaped protrusions 36 in a side by side configuration. In some embodiments the rows of the U shaped protrusions 36 may be staggered with respect to one another so as to allow for some materials following from leading rows of U shaped protrusions 36 to be collected by following rows of U shaped protrusions 36. In some embodiments the conveyor belt may be a PVC120 crescent top belt and the U shaped protrusions 36 may be the crescents provided on the crescent top belt.

The submerged portion of the conveyor belt 30 is in free communication with the liquid solution 3 in the container 1 and may remove magnetic material therefrom without necessitating removing the liquid solution 3 from the container 1. The apparatus 10 may allow for the removal of floating magnetic material and/or other floating material such as, for example, oil and debris, provided on the top 4 of the liquid solution 3 while minimizing the amount of such material that is caused to be suspended in the liquid solution 3 below the top 4 thereof. In some embodiments the U shaped protrusions 36 may aid in the removal of floating material and/or may minimize magnetic material from moving longitudinally or latitudinally off the conveyor 30 during the forward run 32 thereof. In some embodiments the conveyor belt 30 may be rubberized and/or comprise material that is resistant to acidic liquid solutions.

A magnet housing 60 is provided interior of the conveyor belt 30. The magnet housing 60 longitudinally extends between a lower latitudinal side 61 provided interior of and upward from the lower pulley 45 and an upper latitudinal side 62 provided interior of and downward from the upper pulley 47. The magnet housing 60 has a longitudinal side 63 provided immediately adjacent a portion of the frame side support 22 and an opposing longitudinal side 64 provided immediately adjacent the frame side support 24. In some embodiments the magnet housing 60 may be removably affixed to the frame side support 22 and/or the frame side support 24 with one or more fasteners to provide for removability of the magnet housing 60 for cleaning, interchangeability with other magnet housings, or other purposes. In some embodiments the magnet housing 60 may be removably affixed to various locations on the frame side support 22 and/or the frame side support 24 with one or more fasteners to provide for selective adjustment and positioning thereof. In the depicted embodiment the magnet housing 60 is interposed between the conveyor belt 30 and the frame side supports 22 and 24 but the exterior of the magnet housing 60 is not completely liquid tight sealingly separated from the liquid solution 3. In some embodiments the magnet housing 60 may comprise a two piece plastic construction such as, for example, a two piece cast nylon construction. In some embodiments the magnet housing 60 may comprise a single piece integrally formed plastic construction. In some embodiments the magnet housing 60 may comprise a single or multipiece stainless steel construction.

Substantially sealingly enclosed within the magnet housing 60 are three longitudinally extending equidistantly spaced magnets 65. In some embodiments the magnets 65 may be high intensity magnets. With particular reference to FIG. 2, it can be seen that in the depicted embodiment the magnet housing 60 and the magnets 65 are disposed moreso toward the forward run 32 of the conveyor belt 30 to thereby increase the magnetic field proximal the forward run 32. Also, the magnet housing 60 is substantially thicker between the magnets 65 and the rearward run 34 of the conveyor belt to thereby reduce the magnetic field proximal the rearward run 34 and to thereby reduce the magnetic field on the exposed portion of the magnet housing 60 most proximal the rearward run 34. In some embodiments the magnet housing 60 may be at least two times thicker between the magnets 65 and the rearward run 34 of the conveyor belt than it is between the magnets 65 and the forward run 32 of the conveyor belt. In some versions of those embodiments the magnet housing 60 may be at least six times thicker between the magnets 65 and the rearward run 34 of the conveyor belt than it is between the magnets 65 and the forward run 32 of the conveyor belt.

Moreover, the magnet housing 60 is also substantially thicker on the latitudinal ends thereof and the magnets 65 are spaced apart from the latitudinal ends of the magnet housing 60 to thereby reduce the magnetic field on the exposed portion of the latitudinal ends of the magnet housing 60. In some embodiments the magnet housing 60 may be at least two times thicker on the latitudinal ends thereof than it is between the magnets 65 and the forward run 32 of the conveyor belt. In some versions of those embodiments the magnet housing 60 may be at least two times thicker on the latitudinal ends thereof than it is between the magnets 65 and the forward run 32 of the conveyor belt. The amount of magnetic field present on exposed portions of the magnet housing 60 not immediately adjacent the forward run 32 of the conveyor belt 30 is minimized and may thereby minimize buildup of magnetic material on those and other portions of the magnet housing 60. Moreover, the spacing between the magnet housing 60 and portions of the forward run 32 of the conveyor belt 30 may be such as to minimize buildup of magnetic material therebetween. Also, in some embodiments the spacing between the between the magnet housing 60 and portions of the rearward run 34 may be such as to minimize buildup of magnetic material therebetween. In some embodiments portions of the forward run 32 of the conveyor belt 30 may ride atop the magnet housing 60 in contact therewith.

Figure 4:
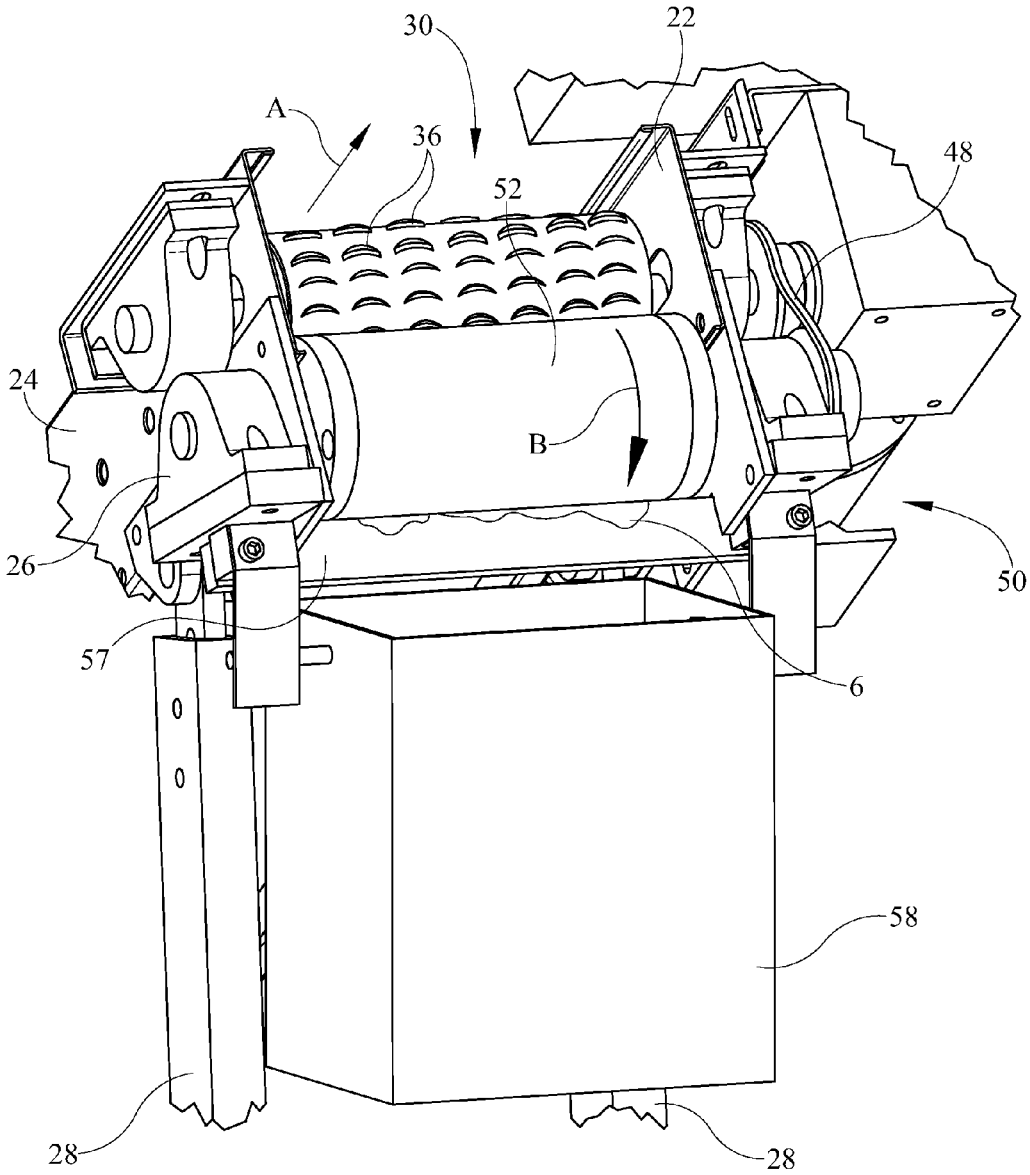
FIG. 4 illustrates a close up view of a portion of the apparatus of FIG. 1, showing a portion of a conveyor belt and scraper assembly of the apparatus in additional detail.

With particular reference to FIG. 2 and FIG. 4, the apparatus 10 includes a scraper assembly 50 adjacent the upper pulley 47 and located entirely longitudinally beyond the magnet housing 60. A portion of the scraper assembly 50 is also provided longitudinally beyond the upper pulley 47. The scraper assembly 50 includes a magnetic drum 52 that is rotated in a direction generally indicated by arrow B by belt 48. Belt 48 is in communication with upper pulley 47 and is driven by the rotation of upper pulley 47 by motor 43. Interior to the magnetic drum 52 are three drum magnets 53 arranged transverse to the direction of rotation of the magnetic drum 52. A scraper 54 extends transverse to the direction of rotation of the magnetic drum 52 and may contact the magnetic drum or be provided immediately adjacent the magnetic drum 52. Positioned below the scraper 54 is a magnetic material catch basin 58. The catch basin 58 is coupled to hingedly adjustable catch basin hinge supports 26 that are coupled to frame side support 22 and 24. The catch basin 58 may be adjusted via catch basin hinge supports 26 to a given orientation to accommodate a given container. The catch basin 58 may also be removed from catch basin hinge supports 26 to, for example empty magnetic material or for replacement with a catch basin having different dimensions. As the conveyor belt 30 transitions from the forward run 32 to the rearward run 34, magnetic material 6 thereon may drop or be pulled onto the magnetic drum 52, where it is thereby carried around to the scraper 54 where it is scraped off the magnetic drum 52 and caused to fall into the catch basin 58.

In some embodiments one or more spray nozzles may be provided at or above the top 4 of the liquid solution 3. The one or more spray nozzles may be attached to the apparatus 10 or attached to the container 1. The spray nozzles may be V-jet spray nozzles coupled to one or more pumps and may direct a flow of output comprising air at the top 4 of the liquid solution 3. The flow of output may be directed in a direction generally toward the conveyor belt 30. The flow of the output may help direct any floating materials toward the conveyor belt 30. In some embodiments one or more devices may be utilized to cause magnetic materials within the liquid solution 3 to be suspended therein.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An apparatus for removing magnetic materials from a liquid solution, the apparatus comprising:

a frame supporting a first pulley and a second pulley distal said first pulley;

an endless conveyor belt rotating about said first pulley and said second pulley, said conveyor belt having a plurality of protruding generally U shaped protrusions integrally formed on an outward facing surface thereof;

wherein said conveyor belt has an upper forward run moving in a forward direction from said first pulley to said second pulley and a lower rearward run moving in a rearward direction from said second pulley to said first pulley;

a longitudinally extending magnet housing interposed between said forward run of said conveyor belt and said rearward run of said conveyor belt and interposed between said first pulley and said second pulley;

at least one longitudinally extending magnet substantially sealingly enclosed in said magnet housing;

wherein a bottom portion of said magnet housing that is interposed between said magnet and said rearward run is at least six times thicker than a top portion of said magnet housing that is interposed between said magnet and said forward run;

a scraper assembly adjacent said second pulley and longitudinally beyond said at least one longitudinally extending magnet housing, said scraper assembly having a rotatable magnetic drum and a scraper immediately adjacent said magnetic drum.

2. The apparatus of claim 1 wherein said magnet housing is an integrally molded piece.

3. The apparatus of claim 2 wherein said magnet housing comprises polypropylene.

4. The apparatus of claim 1 wherein the entirety of said forward run is linear.

5. The apparatus of claim 1 wherein said magnetic drum includes a plurality of equidistantly spaced magnets therein arranged transverse to the rotation of said magnetic drum.

6. The apparatus of claim 1 wherein said apparatus is a self contained apparatus removably insertable into a separate container for removing magnetic materials therefrom.

7. A magnetic material removal system, comprising:

a container containing a liquid solution, said liquid solution having magnetic material therein;

a self contained apparatus partially submerged in said liquid solution, said apparatus including:

a frame supporting a first pulley submerged in said liquid solution and a second pulley distal said first pulley, said second pulley not submerged in said liquid solution and disposed upward and away from said first pulley;

an endless conveyor belt rotating about said first pulley and said second pulley, said conveyor belt being partially submerged in said liquid solution and having a plurality of protruding generally U shaped protrusions integrally formed on an outward facing surface thereof;

wherein the submerged portion of said conveyor belt is in free communication with said liquid solution in said container, wherein said conveyor belt has an upper forward run moving in a forward direction from said first pulley to said second pulley and a lower rearward run moving in a rearward direction from said second pulley to said first pulley, and wherein the entirety of said forward run is linear and at an angle from thirty to sixty degrees with respect to the top of said liquid solution;

a longitudinally extending magnet housing interposed between said forward run of said conveyor belt and said rearward run of said conveyor belt and interposed between said first pulley and said second pulley;

at least one longitudinally extending magnet substantially sealingly enclosed in said magnet housing;

a scraper assembly adjacent said second pulley and located entirely longitudinally beyond said at least one longitudinally extending magnet housing, said scraper assembly having a rotating magnetic drum and a scraper immediately adjacent said magnetic drum.

8. The system of claim 7 wherein said scraper assembly is located immediately adjacent a portion of said rearward run.

9. The system of claim 8 wherein said scraper assembly includes a magnetic material catch basin coupled thereto.

10. The system of claim 7 wherein the entirety of said forward run is at an angle from forty to fifty degrees with respect to the top of said liquid solution.

11. The system of claim 7 wherein the longitudinal length of said magnet housing is less than eighty percent of the longitudinal length of said forward run.

12. The apparatus of claim 11 wherein said magnet housing is an integrally molded piece.

13. The system of claim 7 further comprising at least one nozzle positioned above said liquid solution.

14. The system of claim 13 wherein said nozzle produces an output directed atop said liquid solution in the direction of said apparatus, whereby said output directs floating of said magnetic materials toward said apparatus.

15. The system of claim 14 wherein said output comprises air.

16. The system of claim 7 wherein said magnet housing is removably coupled to said frame.

17. The system of claim 7 wherein said container has a bottom surface, at least two sidewalls extending upwardly from said bottom surface, and a top extending between said at least two sidewalls, said top having an access opening therein; and wherein said apparatus is configured for removable insertion in said container via said access opening.

18. The system of claim 7 wherein a bottom portion of said magnet housing that is interposed between said magnet and said rearward run is substantially thicker than a top portion of said magnet housing interposed between said magnet and said rearward run.

19. The system of claim 18 wherein said bottom portion is at least six times thicker than said top portion.

* * * * *